US007357483B2

(12) United States Patent
Ide et al.

(10) Patent No.: US 7,357,483 B2
(45) Date of Patent: Apr. 15, 2008

(54) INK JET PRINTING APPARATUS AND INK JET PRINTING METHOD

(75) Inventors: Daisaku Ide, Meguro-ku (JP); Hiroshi Tajika, Yokohama (JP); Hitoshi Nishikori, Inagi (JP); Takeshi Yazawa, Yokohama (JP); Atsuhiko Masuyama, Shinagawa-ku (JP); Akiko Maru, Kawasaki (JP); Hirokazu Yoshikawa, Kawasaki (JP); Hideaki Takamiya, Ohta-ku (JP); Akihiko Nakatani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 11/042,103

(22) Filed: Jan. 26, 2005

(65) Prior Publication Data

US 2005/0168507 A1 Aug. 4, 2005

(30) Foreign Application Priority Data

Jan. 30, 2004 (JP) ..... 2004-024842

(51) Int. Cl.
*B41J 2/21* (2006.01)

(52) U.S. Cl. ..... 347/43; 347/12; 347/13

(58) Field of Classification Search ..... 347/12–13, 347/15, 19, 41–43, 5, 9
See application file for complete search history.

(56) References Cited

U.S. PATENT DOCUMENTS

| | | | | |
|---|---|---|---|---|
| 6,412,934 | B1 | 7/2002 | Moriyama et al. | 347/96 |
| 6,527,364 | B2 | 3/2003 | Takahashi et al. | 347/40 |
| 6,557,964 | B2 | 5/2003 | Kawatoko et al. | 347/15 |
| 6,729,710 | B2 | 5/2004 | Chikuma et al. | 347/14 |
| 6,755,496 | B2 | 6/2004 | Nishikori et al. | 347/12 |
| 2003/0035022 | A1 * | 2/2003 | Otsuki | 347/41 |

FOREIGN PATENT DOCUMENTS

| | | | |
|---|---|---|---|
| EP | 1 048 475 | | 11/2000 |
| EP | 1 258 367 | | 11/2002 |
| JP | 2000-177150 | | 6/2000 |
| JP | 2003-072049 | * | 3/2003 |
| JP | 2003072049 A | | 3/2003 |

* cited by examiner

*Primary Examiner*—Lam Son Nguyen
(74) *Attorney, Agent, or Firm*—Fitzpatrick, Cella, Harper & Scinto

(57) ABSTRACT

The ink jet printing apparatus forms an image on a print medium with the following two operations. The printing operation makes a print head perform scan motions in a predetermined direction on the print medium, the print head having an array of nozzle rows corresponding to the required number of ink colors, each scan motion involving the ink being ejected from nozzles onto the print medium. The print medium feeding operation moves the print medium and the print head relative to each other a predetermined amount in a direction different from a direction of the scan motion between the scan motions. In a print mode using a small number of ink colors employed for printing, unidirectional printing is performed such that the nozzle row of a black ink to be ejected reaches a print start position when amplitude of vibration of the print head is a predetermined amount or less.

5 Claims, 9 Drawing Sheets

INK JET PRINTING APPARATUS AND INK JET PRINTING METHOD

BACKGROUND OF THE INVENTION

1. Field of the Invention

The present invention relates generally to an ink jet printing apparatus and an ink jet printing method and, more particularly, to an ink jet printing apparatus and an ink jet printing method preventing degradation of an image quality of a print result attendant on vibration of the apparatus.

2. Description of the Related Art

With the recent development and spread of digital cameras, there is a need for an image quality comparable to that of silver-salt photos even with an ink jet printing apparatus capable of producing an output of a shot image onto a print medium, such as paper or the like, easily in home-use environment.

In addition, there is also a trend, in which more and more digital cameras of a single reflex type are marketed at relatively low prices. Users have then come to require printed results of various forms by the ink jet printing apparatus according to specific needs of the users to the shot images. One example of this trend in user requirements is printing of monochrome photo tone images popular in silver-salt photos as well as color photo tone images.

Generally speaking, black ink is mainly used in printing of the monochrome photo tone image. A monochrome image using black ink only is, however, recognized as being slightly tinted with color. For this reason, cyan (or magenta) and yellow inks are used for correcting color tone, in addition to the black ink that serves as a basic tone of the monochrome image. Further, in order to lessen a granular impression in low and middle gradations, it is practice to create gray using light cyan and yellow inks. However, a dot formed by ejecting ink may land on a position deviated from a predetermined position. If this deviation of landing position happens, an intended achromatic color can not be created. In this case, a color other than an achromatic color serving as the basic tone in printing of the monochrome image is evident in a printed image. The deviated dot, then, appears inordinately noticeable in the image. In performing monochrome printing, therefore, it is desirable that an amount of chromatic color inks to be used are minimized as much as possible.

An attempt has been also made to improve image quality by mounting on the apparatus a plurality of inks of achromatic colors with varying concentrations (gray ink or the like), instead of a plurality of inks of chromatic colors including cyan, magenta, yellow and the like, and rendering gradation of a monochrome image using the plurality of inks of achromatic colors with varying concentrations (see JP 2000 177150A). In recent years, a number of apparatuses mounted with a plurality of inks with varying concentration of black have been also put on the market.

There may be cases, in which all gradations covering from a highlight portion to a maximum optical density portion (a solid area density portion) are printed using only ink (e.g., black ink in a monochrome photo tone image) that can create an output of the maximum optical density of a basic tone color. In such cases, particularly in middle gradation, granular impression with the deviation in landing positions of dots is noticeable. This is because of the following reason. The total amount of ink applied to a predetermined area on a print medium is smaller in monochrome printing than in color printing or printing using the above plurality of inks of achromatic colors. Accordingly, the surface coverage of ink on the surface of the print medium becomes lower in monochrome printing. To state it another way, the lower the surface coverage of ink on the surface of the print medium, the more noticeable the deviation in the landing position of each dot. Additionally, contrast in monochrome printing is higher than that in color printing, because in monochrome printing black ink is deposited on a white print medium. A portion of dots locally concentrated due to the deviation of the landing positions tends to become noticeable as rendered as black lines or the like.

A dominant type of home-use ink jet printing apparatuses in late years is a serial type. The serial type printing apparatus carries out printing on the entire surface of the print medium by performing a printing operation and a paper feeding operation repeatedly. In the printing operation, the apparatus lets a carriage mounted with a print head scan in the main scanning direction to perform printing. In the paper feeding operation, the apparatus transports the print medium in the sub-scanning direction.

FIG. 1 is a view showing a serial type ink jet printing apparatus. Generally, the serial type ink jet printing apparatus performs printing by letting a carriage 6 mounted with a print head scan in a predetermined direction (an outgoing scan) over a print medium along a guide rail 9. When the carriage 6 reaches one end, a paper feed is performed for a predetermined amount. Then, the carriage 6 scans in a direction (a return scan) opposite to the previous scan. To shorten a period of time required for printing, it is common practice to make the apparatus perform a bidirectional printing, in which printing is performed in both the outgoing and return scans.

The inventors, however, experimentally found that a printed image in a monochrome photo tone through the bidirectional printing method was generated an unevenness of density that would not be evident in a printed image in a color photo tone. This unevenness is cyclical in the main scanning direction, generating throughout an entire area in the sub-scanning direction of the printed image.

Further, the inventors took particular note of the fact that the unevenness generated cyclically near an end of the print medium, that is, near a point at which the carriage changed a direction of scan thereof. The inventors thus found that vibration occurring at reversal of the scanning direction of the carriage triggered deviation in landing positions of the dots. The inventors also have considered a reason for the unevenness generating in the monochrome photo tone image as follows. The deviation in dot landing positions in the monochrome photo tone image is more noticeable than that in color printing or the like because of the surface coverage of ink on the surface of the print medium and contrast between the print medium and ink color.

The present invention is intended to solve the aforementioned problems, in particular, the problem of the unevenness of density generating cyclically near the point of reversal of the scanning direction of the carriage. It is therefore an object of the present invention to provide an ink jet printing apparatus and an ink jet printing method for producing an output of a printed result of high image quality without allowing deviation in dot landing positions to be noticeable even with a small number of colors of ink used for printing.

SUMMARY OF THE INVENTION

An ink jet printing apparatus according to the present invention forms an image on a print medium by performing a printing operation and a print medium feeding operation.

Specifically, the printing operation is performed by making a print head carry out a plurality of scan motions in a predetermined direction on the print medium. The print head has an array of a plurality of nozzle rows corresponding to the required number of colors of ink to be ejected and each nozzle row includes a plurality of nozzles. Each scan motion involves the ink being ejected from the plurality of nozzles onto the print medium.

The print medium feeding operation is performed by moving the print medium and the print head relative to each other a predetermined amount in a direction different from a direction of the scan motion of the print head.

The ink jet printing apparatus comprises print mode selection means for selecting one print mode among a plurality of print modes including a first print mode and a second print mode, the first print mode using a relatively large number of colors of ink employed for printing and the second print mode using a number of colors of ink smaller than in the first print mode and control means for controlling the printing operation according to the print mode selected by the print mode selection means.

The apparatus is characterized in the following points. Specifically, the control means controls so that in the first print mode bidirectional printing, in which a printing operation is performed during scan motions both in the predetermined direction and a direction opposite thereto, is carried out, and in the second print mode unidirectional printing, in which a printing operation is performed only during a scan motion in one direction of the predetermined direction and the direction opposite thereto, is carried out.

A printing system according to the present invention uses an ink jet printing apparatus that forms an image on a print medium by performing a printing operation and a print medium feeding operation.

Specifically, the printing operation is performed by making a print head carry out a plurality of scan motions in a predetermined direction on the print medium. The print head has an array of a plurality of nozzle rows corresponding to the required number of colors of ink to be ejected and each nozzle row includes a plurality of nozzles. Each scan motion involves the ink being ejected from the plurality of nozzles onto the print medium.

The print medium feeding operation is performed by moving the print medium and the print head relative to each other a predetermined amount in a direction different from a direction of the scan motion of the print head.

The printing system comprises print mode selection means for selecting one print mode among a plurality of print modes including a first print mode and a second print mode, the first print mode using a relatively large number of colors of ink employed for printing and the second print mode using a number of colors of ink smaller than in the first print mode and control means for controlling the printing operation according to the print mode selected by the print mode selection means.

The system is characterized in the following points. Specifically, the control means controls so that in the first print mode bidirectional printing, in which a printing operation is performed during scan motions both in the predetermined direction and a direction opposite thereto, is carried out, and in the second print mode unidirectional printing, in which a printing operation is performed only during a scan motion in one direction of the predetermined direction and the direction opposite thereto, is carried out.

An ink jet printing method according to the present invention uses an ink jet printing apparatus that forms an image on a print medium by performing a printing operation and a print medium feeding operation.

Specifically, the printing operation is performed by making a print head carry out a plurality of scan motions in a predetermined direction on the print medium. The print head has an array of a plurality of nozzle rows corresponding to the required number of colors of ink to be ejected and each nozzle row includes a plurality of nozzles. Each scan motion involves the ink being ejected from the plurality of nozzles onto the print medium.

The print medium feeding operation is performed by moving the print medium and the print head relative to each other a predetermined amount in a direction different from a direction of the scan motion of the print head.

The ink jet printing method comprises a print mode selection process for selecting one print mode among a plurality of print modes including a first print mode and a second print mode, the first print mode using a relatively large number of colors of ink employed for printing and the second print mode using a number of colors of ink smaller than in the first print mode and print process for performing the printing operation according to the print mode selected by the print mode selection means.

The method is characterized in the following points. Specifically, the print process performs so that in the first print mode bidirectional printing, in which a printing operation is performed during scan motions both in the predetermined direction and a direction opposite thereto, is carried out, and in the second print mode unidirectional printing, in which a printing operation is performed only during a scan motion in one direction of the predetermined direction and the direction opposite thereto, is carried out.

Specifically, unidirectional printing is carried in the second print mode, in which ink coverage in a predetermined area in the print medium is relatively low because of a smaller number of colors of ink used for printing. In the second print mode, printing is done only in a scanning direction, in which a nozzle row of a predetermined color (e.g., achromatic color) that makes deviation in the ink dot landing positions readily noticeable reaches a print start position when amplitude of vibration of the print head is a predetermined amount or less during a scan motion of the print head. The present invention is thus effective in preventing an unevenness occurring from deviation in the ink dot landing positions caused by vibration generated when the print head remains shaky at the reversal of the scanning direction. The present invention is also capable of producing an output of a print result of high image quality even with a small number of colors of ink used for printing.

In the print mode, in which a small number of colors of ink are used for printing, the number of scan motions of the print head that is required to make to form an image of a predetermined area is made larger. This helps make deviation in the ink dot landing positions less noticeable.

Further, providing both the first print mode and the second print mode allows a period of time it takes to print to be shortened in bidirectional printing for color printing. It is also possible to produce an output of a print result of high image quality at all times, although the number of colors of ink used in color printing and monochrome printing varies.

The above and other objects, effects, features and advantages of the present invention will become more apparent from the following description of embodiments thereof taken in conjunction with the accompanying drawings.

DETAILED DESCRIPTION OF PREFERRED EMBODIMENT

Preferred embodiments of the present invention will be described in detail with reference to the accompanying drawings.

Figure 1:
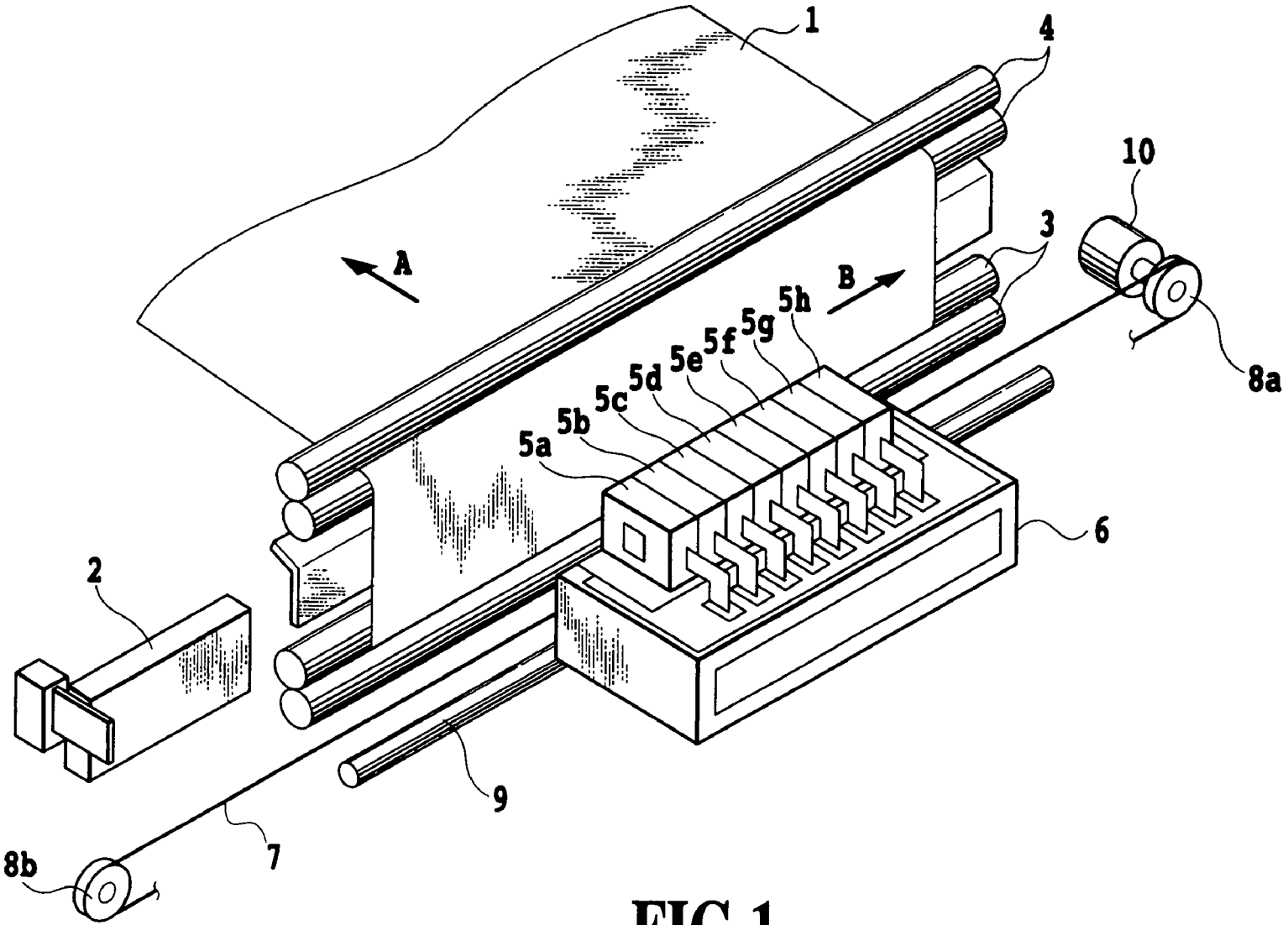
FIG. 1 is a perspective view showing an ink jet printing apparatus according a preferred embodiment of the present invention.

FIG. 1 is a view showing a typical ink jet printing apparatus applicable to the present invention. A reference numeral 1 represents paper, a plastic sheet, or other print medium of a sheet form (hereinafter also referred to as a "print sheet"). A stack of a plurality of print sheets 1 loaded in a cassette or the like is fed, one at a time, by a pick-up roller (not shown). A reference numeral 3 represents a pair of first feed rollers and a reference numeral 4 represents a pair of second feed rollers. The pair of first feed rollers 3 and the pair of second feed rollers 4 are disposed at a predetermined distance away from each other. Each of pairs is driven by an individual stepping motor (not shown) to transport the print sheet 1 in a direction of arrow A.

A reference numeral 5 represents an ink tank connected to a print head that includes an array of a plurality of nozzles for ejecting ink. A reference numeral 6 represents a carriage mounted with the ink tank 5 and the print head. The print head is mounted on the carriage 6 such that nozzle surfaces oppose the print sheet 1.

The carriage 6 is coupled to a carriage motor 10 via a belt 7 and pulleys 8*a*, 8*b*. It is therefore so configured that the carriage 6 is driven by the carriage motor 10 to make a reciprocating scan motion along a guide shaft 9.

Through the configuration as described in the foregoing, the carriage 6 moves from a home position in a direction of arrow B by way of a proximal end (a left side end in FIG. 1) of the print sheet 1 (this motion is referred to as a "main scan"). At this time, the print head ejects ink to the print sheet 1 according to an ejection signal. After the carriage 6 moves to a distal end (a right side end in FIG. 1) of the print sheet 1, the carriage 6 then returns to the home position as necessary. At the home position, the carriage 6 removes clogging from the nozzle by using an ink recovery device 2. The feed roller pairs 3, 4 are then driven to transport the print sheet 1 in the direction of arrow A over a distance equivalent to one line (this motion is referred to as a "sub-scan"). The main scan as the motion for printing and the sub scan as the paper feed motion are alternately repeated and thereby required printing is performed on an entire surface of the print sheet 1.

According to the preferred embodiment of the present invention, the ink tank 5 includes tanks of the following eight colors. The eight colors are specifically: cyan (C), magenta (M), yellow (Y), black (Bk), light cyan (Lc) having a lower concentration than cyan, light magenta (Lm) having a lower concentration than magenta, and special colors of green (G) and red (R) that have a different hue from those cited earlier. The number of and combination of ink colors to be mounted is not limited to the afore-mentioned embodiment. For example, the number and combination may be four colors of C, M, Y, and Bk, or six colors excluding the special colors from eight colors of the afore-mentioned embodiment. The ink tanks are arranged in the following order. Specifically, starting with the side closest to the home position (HP), a light magenta 5a, a red 5b, a black 5c, a green 5d, a light cyan 5e, a cyan 5f, a magenta 5g, and a yellow 5h are arranged. The arrangement of the ink tanks corresponds to the arrangement of nozzle trains of the print head to be described below.

Figure 2:
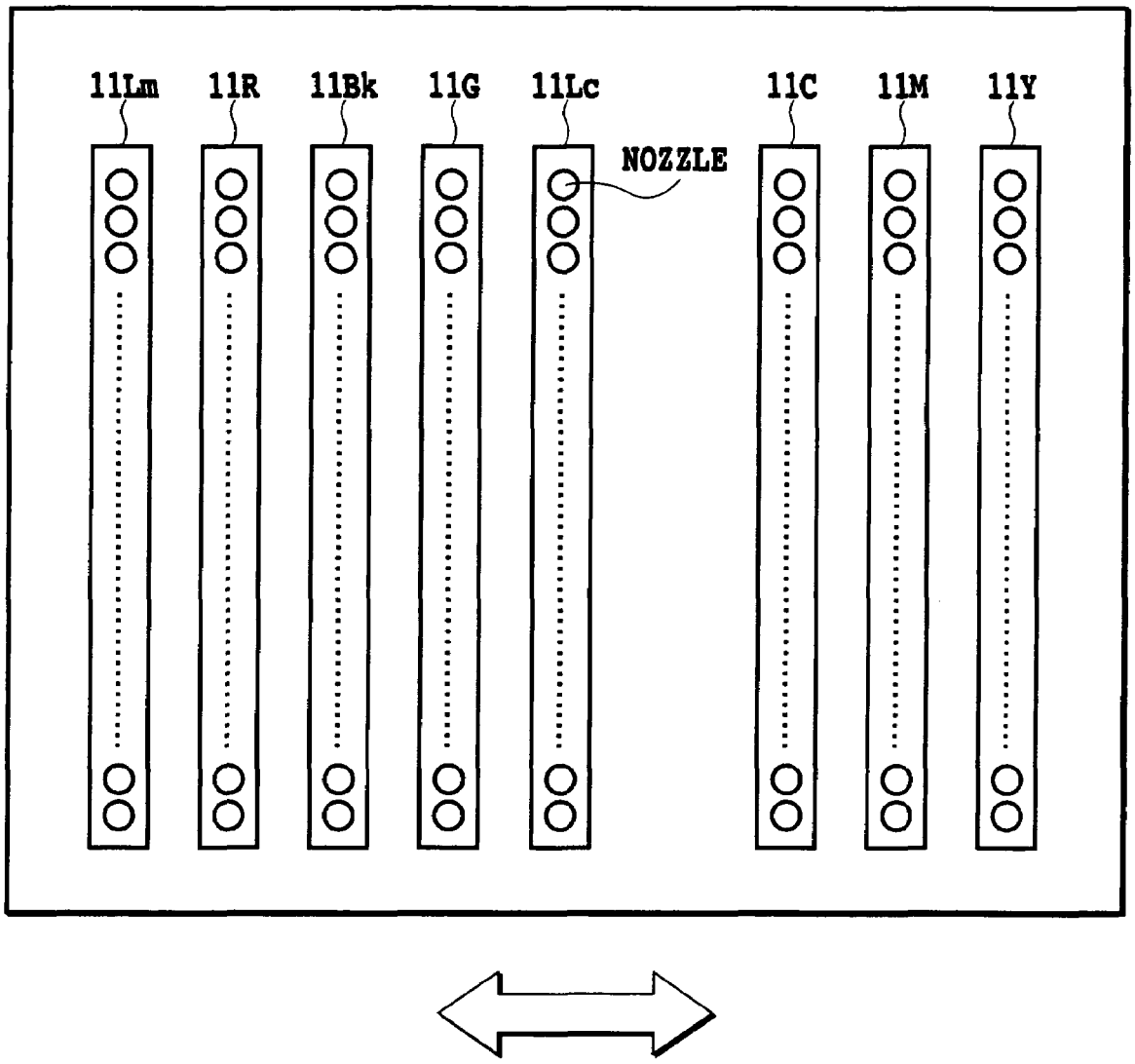
FIG. 2 is a schematic view showing nozzle rows of a print head.

FIG. 2 is a schematic view showing the print head according to the preferred embodiment of the present invention. FIG. 2 shows the surface opposing the print medium, that is, a nozzle surface. The print head is mounted in the printing apparatus such that the nozzle surface opposes a print surface of the print sheet to be transported. The print head according to the preferred embodiment of the present invention is arranged as follows. Specifically, a plurality of nozzles disposed in the nozzle surface for each color of ink to be ejected is arranged in a row. The direction in which the plurality of nozzles is arranged is vertical relative to the scanning direction of the print head. Further, nozzle rows are arranged in the scanning direction of the print head. These allow printing to be efficiently performed over a wide range with a single print scan motion. Referring again to FIG. 2, the nozzle rows are arranged in the order of, from the home position side, a nozzle row for light magenta 11Lm, a nozzle row for red 11R, a nozzle row for black 11Bk, a nozzle row for green 11G, a nozzle row for light cyan 11Lc, a nozzle row for cyan 11C, a nozzle row for magenta 1M, and a nozzle row for yellow 11Y. The print head is connected to the ink tank. Each nozzle is charged with ink supplied from the ink tank 5 holding the corresponding color of ink.

Each nozzle row includes 512 nozzles arranged at a pitch of 1200 dpi. Each nozzle is provided with a heater. Upon ejection of ink, the heater is heated to generate air bubbles in part of the ink near an ejection port. A predetermined amount of ink is ejected as an ink droplet in a predetermined direction through a pressure generated by the air bubbles. As such, the printing apparatus according to the preferred embodiment of the present invention employs an ink ejection method according to a bubble jet system. It should, however, be understood that the present invention is not limited thereto. It will be obvious that another ink ejection method, such as a piezo system or the like, may be employed.

Each of the nozzles arranged in the print head ejects ink when the corresponding heater is individually driven on the basis of image data. Each nozzle is capable of producing a small dot of about 2 nanogram (ng) ink ejected therefrom.

A structure of a printing system including a host computer and an ink jet printing apparatus will be described in the following.

Figure 3:
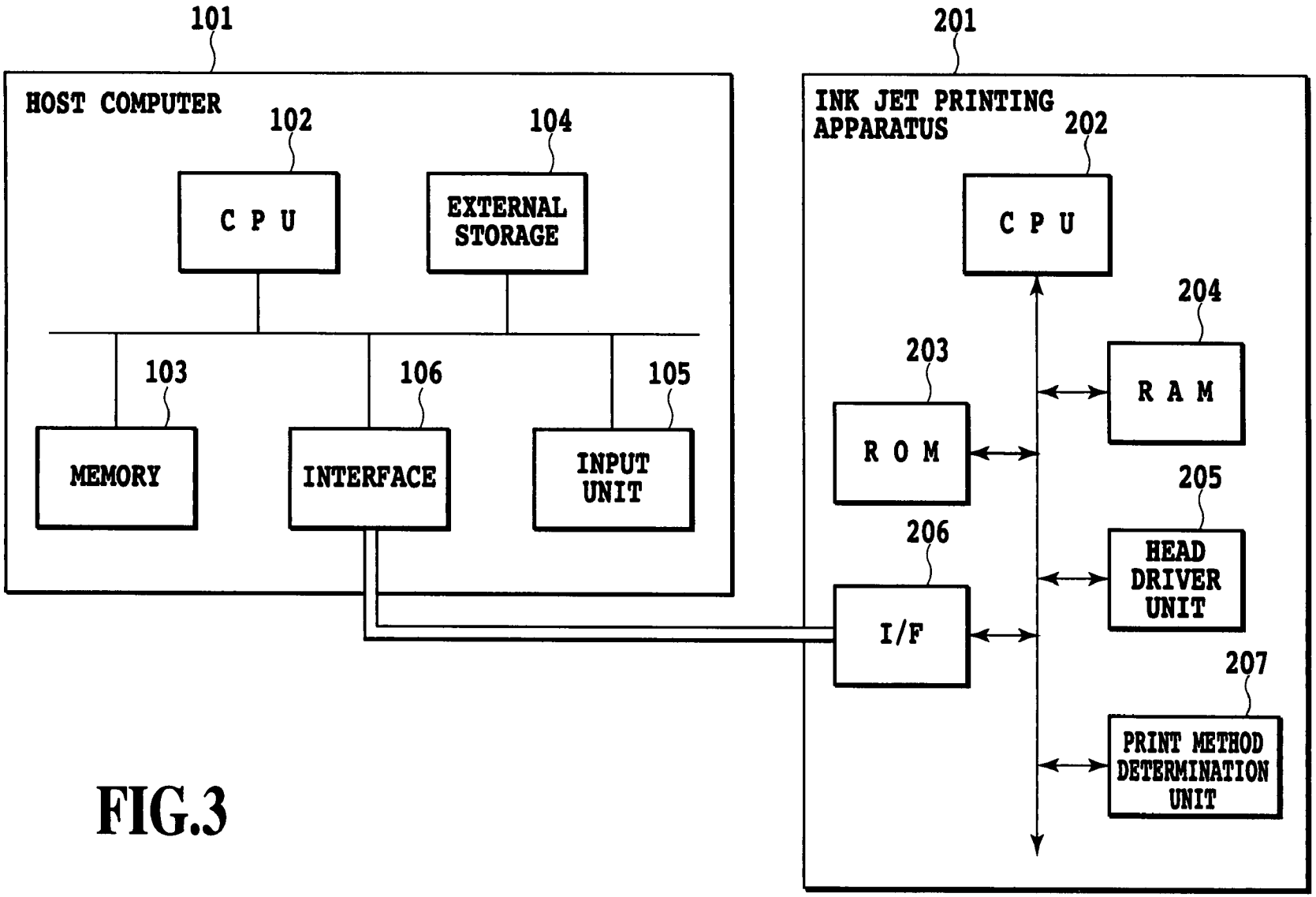
FIG. 3 is a block diagram showing an ink jet printing system according to a preferred embodiment of the present invention.

FIG. 3 is a block diagram showing a printing system according to a preferred embodiment of the present invention.

The system comprises a host computer 101 and an ink jet printing apparatus 201. The host computer 101 includes a CPU 102, a memory 103, an external storage 104, an input unit 105, and an interface to the ink jet printing apparatus 201. The ink jet printing apparatus 201, on the other hand, includes a CPU 202, a ROM 203, a RAM 204, a driver unit (not shown), an I/F 206, a print method determination unit 207, and the like. More specifically, the CPU 202 performs an overall control of the ink jet printing apparatus 201. The ROM 203 stores a control program. The RAM 204 serves as a work memory. The driver unit controls driving of driving members represented by a head driver unit 205 that controls driving of the print head. The I/F 206 serves as an interface to the host computer 101. The print method determination unit 207 determines the specific print method according to the print mode.

The CPU 102 of the host computer 101 realizes color processing and quantization processing to be described later by executing the program stored in the memory 103. It is here assumed that a portion within the CPU 102 performing color transformation processes is called a color processing unit and that a portion within the CPU 102 performing quantization processes for data that has been color-processed is called a quantization unit. Programs corresponding to these different processing units are stored in the external storage 104 or provided by an external device. The host computer 101 is connected to the ink jet printing apparatus 201 via the interface 106. The host computer 101 transmits the print data that have performed color processing and the like to the ink jet printing apparatus 201. When the ink jet printing apparatus 201 receives the print data, the print method determination unit 207 determines the applicable print method according to the print data and then prepares ejection data corresponding to each nozzle and then the head driver unit 205 drives corresponding nozzles to carry out printing according to the ejection data.

The printing system according to the preferred embodiment of the present invention is provided with a plurality of print modes, each representing a specific feature required for a print result. The plurality of print modes include at least a color print mode, in which an image of an ordinary color photo tone is printed, and a monochrome print mode, in which an image of an ordinary monochrome photo tone is printed. Printing is carried out using the specific print method as appropriately determined according to the mode selected by the user.

A flow of image processing performed by the host computer will next be described in detail.

Figure 4:
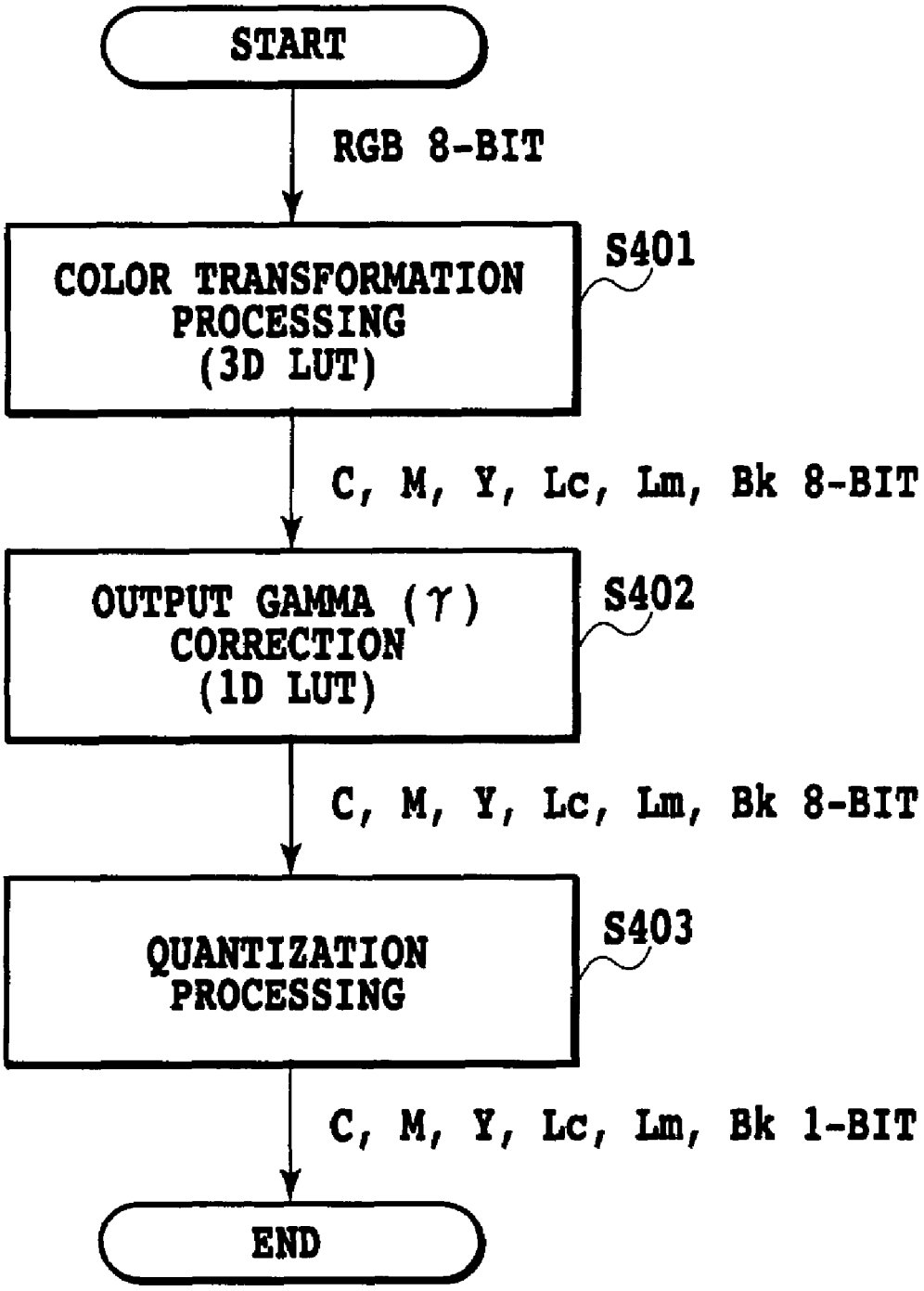
FIG. 4 is a flowchart showing a flow of color transformation process and quantization process.

FIG. 4 is a flowchart for illustrating image processing. The flowchart shows that 8-bit (256 gradations) image data of each color of R (red), G (green), and B (blue) inputted is outputted as 1-bit data of each of C, M, Y, Lc, Lm, Bk, G, and R.

The 8-bit data of each color of R, G and B is first transformed to the 8-bit data of each color of C, M, Y, Lc, Lm, Bk, G, R corresponding to an output color of the printing apparatus by a three dimensional lookup table (3D LUT) (step 401). This process is to transform an RGB-based color inputted to a CMY-based color outputted. Specifically, the input data representing the three primary colors (RGB) for the additive mixture of color, such as a display or other light emitting body, must be transformed to data suitable for CMY-based colors used in the ink jet printing apparatus.

The 3D LUT used for color processing retains data discretely. Data other than data retained in the 3D LUT is obtained through interpolation. The interpolation is a known technique and a detailed description of the same will be omitted herein.

The 8-bit data of each color of C, M, Y, Lc, Lm, Bk, G, R, which the color processing has been performed, is then subjected to an output gamma (y) correction performed by a single dimensional LUT (1D LUT) (step 402). The relationship between the number of print dots per unit area and an output characteristic (reflection density or the like) is not in many cases linear. A linear relation is therefore guaranteed by the output gamma (y) correction between the input level of 8-bit data of each color and the output characteristic at that particular time.

The operation of the color processing unit has so far been explained. Specifically, the 8-bit data of each of input colors, R, G, B has been transformed to 8-bit data of each of output colors, C, M, Y, Lc, Lm, Bk, G, R that the printing apparatus has.

The ink jet printing apparatus according to the preferred embodiment of the present invention is a binary printing apparatus. The 8-bit data of each of colors are therefore quantized to binary data of each of colors by the quantization unit (step 403). The conventionally known error diffusion technique or dithering technique is used for quantization.

A plurality of 3D LUT's used for color processing is provided according to ink color configurations and print result requirements. The specific 3D LUT is selected according to the print mode or the like. Specifically, according to the preferred embodiment of the present invention, at least two types of 3D LUT's are provided, one for the color print mode and the other for the monochrome print mode. Each type of LUT's has a specific processing parameter. For example, a 3D LUT for eight-color print mode transforms RGB 8-bit data to C, M, Y, Lc, Lm, Bk, G, R 8-bit data. The color print mode is not limited to the aforementioned eight colors. Rather, the color print mode may be a configuration of C, M, Y, and Bk only. Or, the color print mode may even be a configuration of six colors of the aforementioned four, plus Lm and Lc. It goes without saying that the color print mode may further be subdivided into the 8-color mode, 4-color mode, and the like. A 3D LUT for the monochrome print mode transforms RGB 8-bit data to Bk, C, Y 8-bit data. According to the preferred embodiment of the present invention, cyan and yellow are added for color tone correction to the colors of ink in the monochrome print mode. It should be noted that black only should perfectly serve the purpose.

The 1D LUT following the 3D LUT may be provided in multiple numbers for different modes as with the 3D LUT's or one provided commonly for all modes.

A flow from mode selection by the user to generation of print data will be described.

Figure 5:
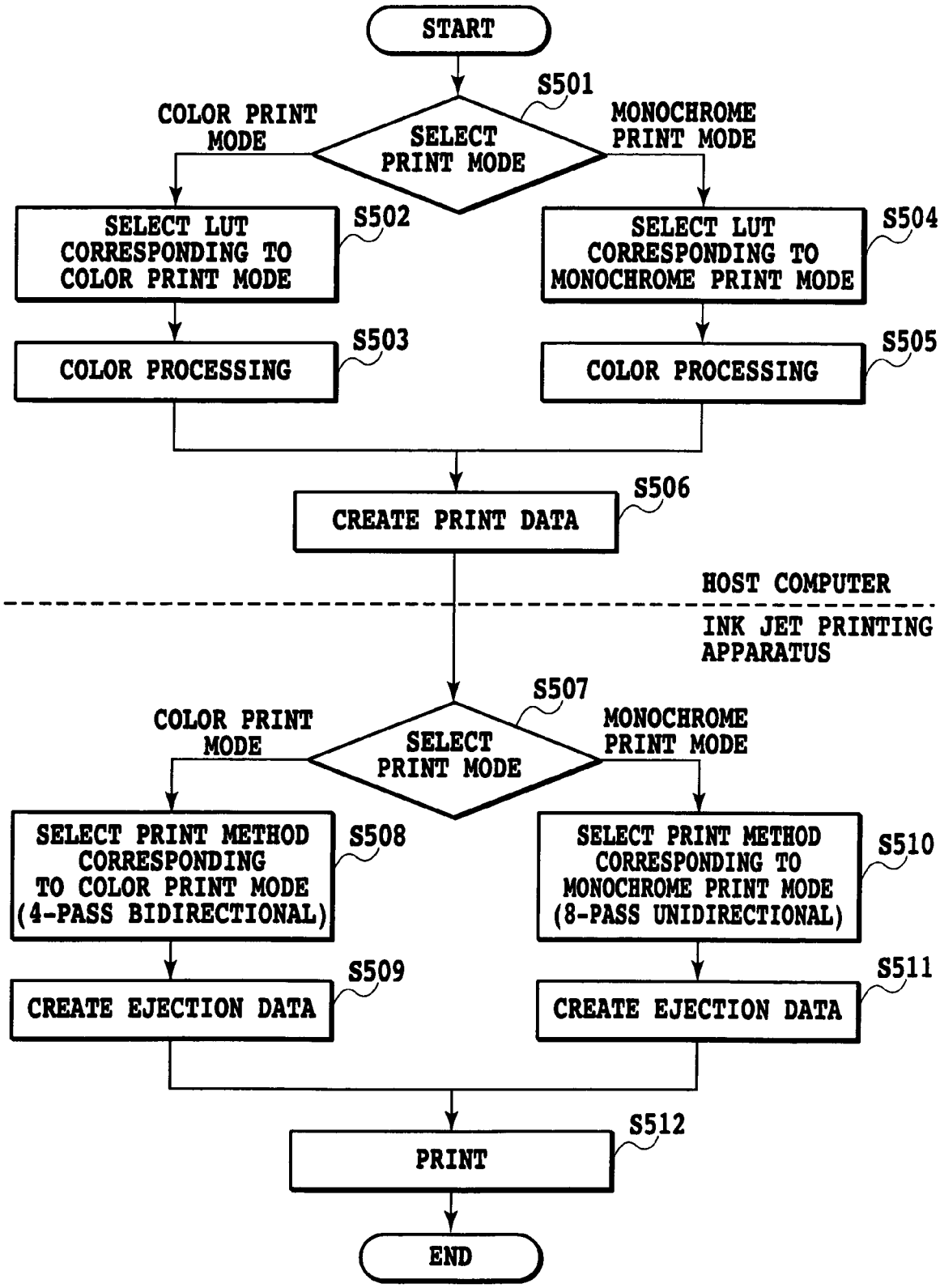
FIG. 5 is a flowchart showing an entire flow up to printing for different print modes.

FIG. 5 is a flowchart showing a flow from mode selection to generation of print data according to the preferred embodiment of the present invention.

The user selects a print mode using an operation screen, an operation button, or the like of the host computer (step 501). If, for example, the color print mode is selected (step 502), the color transformation processing using the 3D LUT for the color print mode is performed (equivalent to the processing performed in step 401 of FIG. 4) (step 503). If the monochrome print mode is selected (step 504), on the other hand, the color transformation processing using the 3D LUT for the monochrome print mode is performed (step 505). When the color transformation processing in step 503 or step 505 is completed, the aforementioned output gamma (γ) correction, quantization correction, or the like is performed so that the print data is created (step 506). The created print data is transferred to the printing apparatus and printing is carried out by the printing apparatus.

The present invention varies the print method employed according to the print mode. In order to vary the print method according to the print mode, the ink jet printing apparatus that receives the print data therefore processes the print data to prepare ejection data corresponding to each nozzle.

Print methods according to different print modes will be described in the following. Specific print methods will be described based on the following specific embodiments. Processing performed by the ink jet printing apparatus in FIG. 5 (processing of step 507 and onward) will be described in Embodiment 1.

Embodiment 1

In Embodiment 1, the print methods will be described in the monochrome print mode using black, cyan, and yellow and in the color print mode using all eight colors of ink loaded in the apparatus. According to Embodiment 1, the number of colors of ink employed for printing is smaller in the monochrome print mode than in the color print mode. Unidirectional printing is carried out in the monochrome mode, whereas bidirectional printing is performed in the color print mode.

Figure 6A:
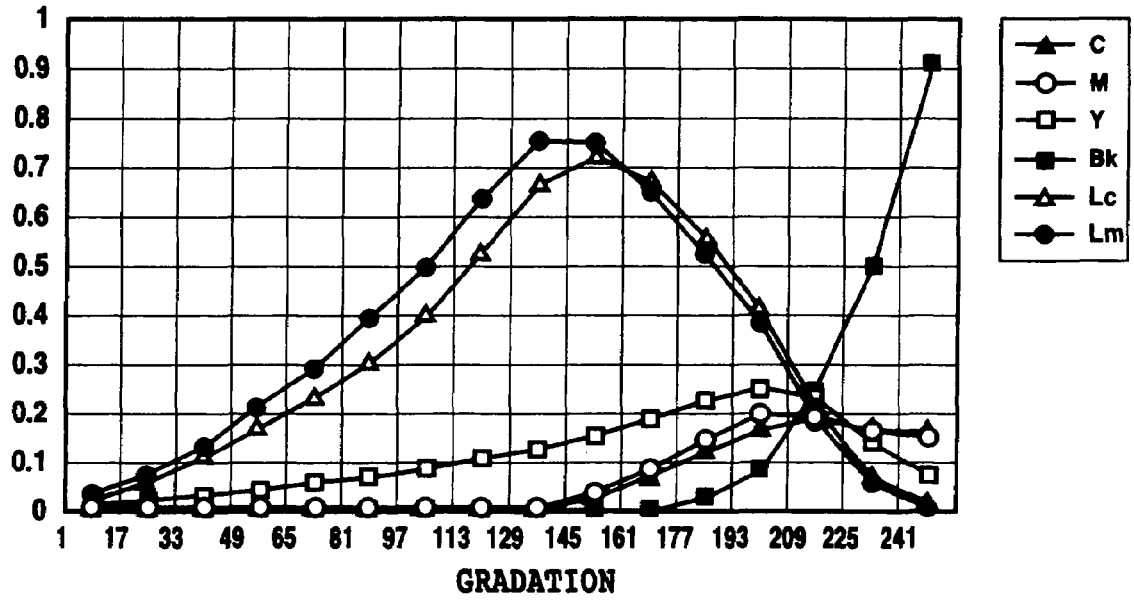
FIG. 6A is a graph showing a relation between a gradation value and an ink usage rate in a color print mode.
Figure 6B:
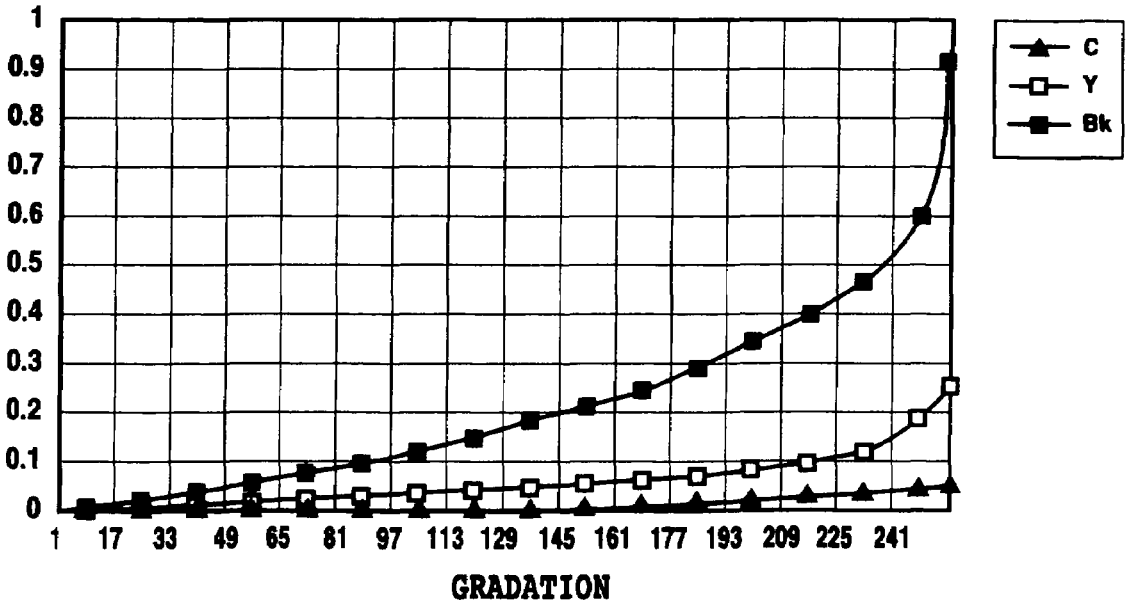
FIG. 6B is a graph showing a relation between a gradation value and an ink usage rate in a monochrome print mode.

Because of the ink coverage involved on the surface of the print medium and the contrast involved between the print medium and the ink color mentioned earlier, deviation in dot landing positions tends to be more noticeable in the print result of the monochrome print mode than in the print result of the color print mode. In Embodiment 1, therefore, different print methods are used between the monochrome print mode and the color print mode. In either of the two print modes, print results of high quality are thereby achieved. Specifically, the following approach is taken as first means. In the monochrome print mode, the image is formed by making the print head scan the predetermined area a greater number of times (hereinafter referred to as a "pass count") than in the color print mode. For example, bidirectional printing is performed in the color print mode and unidirectional printing is performed in the monochrome mode, in which a smaller number of colors of ink are used than in the color print mode. In unidirectional printing, a half of the total number of scan motions is done without involving printing. The number of scan motions is therefore more in the monochrome print mode. Further, the print result of high quality can also be achieved by varying the pass count required to complete an image in a multi-pass printing between the monochrome print mode and the color print mode. In multi-pass printing, the image is completed through a plurality of scan motions. FIGS. 6A and 6B are graphs showing relations between black gradation values and ink usage rates in different modes. FIG. 6A is the graph for the color print mode, while FIG. 6B is the graph for the monochrome print mode. Specifically, FIG. 6A shows output values or ink usage rates of different colors of ink corresponding to black gradation values in the color print mode. Herein, light cyan (Lc) and light magenta (Lm) having lower color concentrations are used, in addition to cyan (C), magenta (M), yellow (Y), and black (Bk). According to FIG. 6A, Lc, Lm, and Y are used to represent different gradations in a low density zone. In a transition phase with a gradual increase in density from a low density to a high density, dots tend to be printed discretely and ink with an even lower concentration is used to reduce a granular impression. This approach is taken, since ink dots formed by ink of a light color are less noticeable on the print medium.

FIG. 6B shows output values of different colors of ink corresponding to black gradation values in the monochrome print mode. According to FIG. 6B, the black ink stably maintains high output values than ink of other colors and exhibits a samey increase trend both in a highlight zone with lower density values and a high density zone with high density values. In FIG. 6B, cyan and yellow are the only two colors of ink applied other than black. The output signal values of these two colors keep a low level. In Embodiment 1, these two chromatic colors are added for correcting of "coloring" of a black image. In the example of FIG. 6B, the ink of one chromatic color (the yellow ink) of the ink of the two chromatic colors (cyan and yellow ink) is used throughout the entire density zones from the low density zone to the high density zone as with the black ink. The amount used of ink of the other chromatic color (the cyan ink) is kept smaller as compared with that of the ink of the other chromatic color (yellow).

In FIG. 6B, yellow and cyan are used as the chromatic colors. Depending on the composition of the black ink to be used, however, the chromatic colors employed for correcting the coloring may be yellow and magenta.

A comparison of the middle gradation levels of FIGS. 6A and 6B will reveal that the amount of ink applied to the print medium is apparently smaller in the monochrome print mode than in the color print mode. In addition, in the monochrome print mode, the black ink is positively used even in the low to middle gradation levels, resulting in a ratio of the black ink to the total amount of ink applied being extremely high.

More specifically, the black ink is used so that luminance γ is about 1.8 from the highlight portion to the maximum density portion. If the amount of black ink used per unit area increases, even though the black ink is used as an achromatic ink, the ink exhibits slight chroma depending on the type of the print medium used. This at times results in tone not right for a monochrome photo being produced. According to Embodiment 1, therefore, cyan and yellow are used as coloring correcting components to achieve the original achromatic color of black. In printing of a monochrome image, an extremely small amount of cyan and yellow is thereby added. IN order to correct the coloring, cyan and yellow are used in Embodiment 1; however, cyan and yellow are not the only ink of colors and magenta or any other color may be used. The important point to remember herein is that ink of these chromatic colors is used only as coloring correcting components and that the ink of these chromatic colors is not used for generating gray or process black for making gradation changes smoother. The extremely small addition of the ink of these chromatic colors is to prevent image quality from degrading that deviation in landing positions of dots of chromatic colors causes the original colors of the ink of these chromatic colors to be evident on the print medium and thereby dots of ink of chromatic colors are noticeable in a monochrome photo image.

It is further designed to increase the amount of each ink used from the highlight portion to the maximum density portion at a samey pace in order to make it easier to create color tones and gradations of monochrome photos. This helps make color tones uniform throughout the highlight portion, the middle density portion, and the maximum density portion even with unit-to-unit variations in mass-production of the ink jet printing apparatuses.

Changes in the pass count in the print method in each of different print modes having such an ink usage rate will be described.

There is a print method called a one-pass print, in which all nozzles of the print head are used to print during one main scan motion and the paper is fed over a distance equivalent to the width of the nozzle row. This one-pass print method covers a wide print width in one pass, requiring a shorter period of time for printing; however, deviation in dot landing positions is readily and directly incorporated in the print image. For example, uneven lines occur due to deviation in landing positions. To prevent the image quality from degrading as caused by such a landing error, therefore, the multi-pass print method, in which the pass count over the aforementioned predetermined area is increased to complete the image, is employed.

Referring back to FIG. 5, according to Embodiment 1, the print method determination unit 207 of the ink jet printing apparatus determines the print method based on the print data transmitted from the host computer. The selection of the print mode by the printing apparatus, whether the mode be the color print mode or the monochrome print mode, may be determined based on the print data transferred from the host computer. Alternatively, the host computer may transmit a command indicating the print mode, together with the print mode, and the printing apparatus may analyze the command and, based on the analysis made, select the print mode. The print mode, in which printing is carried out, is thus determined and processing is then performed according to the print mode.

In the color print mode according to Embodiment 1, a 4-pass print method is selected (step 508). The 4-pass print method uses print data divided into ¼ at random so as to complete the image of the predetermined area through four main scan motions and a paper feed of ¼ of the width of the nozzle row. This print method is called the multi-pass print. In the multi-pass print method, a print motion by scanning of the print head and a paper feed motion covering a width narrower than a print width in the paper feed direction printed through one scan motion by the print head are repeated and thereby the printing of the image over a predetermined area on the print medium is completed through a plurality of scan motions by the print head.

In the monochrome print mode, on the other hand, an 8-pass print method corresponding to the pass count doubling that of the color print mode is selected (step 510). Ejection data corresponding to the respective print methods are then created (steps 509 and 511). Printing is then carried out based on the ejection data (step 512). According to Embodiment 1, the ink jet printing apparatus creates the ejection data. The present invention is not, however, limited to that creation, and the ejection data may be created by the host computer.

The carriage scan method according to each mode will be next described.

To shorten time required for printing, printing has conventionally been carried out in both directions of the ongoing direction of the carriage (the direction of arrow B in FIG. 1) and the return direction (the direction opposite to the direction of arrow B) (this print method is hereinafter referred to as the "bidirectional printing"). In the color print mode according to Embodiment 1, therefore, a 4-pass bidirectional printing is carried out with particular emphasis on the print speed. Herein, the bidirectional printing is carried out also in the monochrome print mode. The inventors then found experimentally that unevenness cyclical in the main scanning direction, which was not observed in the color printing carried out through the 4-pass bidirectional printing, was generated in 8-pass printing having a pass count (the number of scan motions made by the print head to complete an image of the same area) of eight for printing. In what is called the multi-pass printing, in which the image is completed by making the print head scan anumberof times, it is known that unevenness of density arising from part-to-part variations in the plurality of nozzles placed in the print head becomes less noticeable with the increasing pass count. As described above, unevenness occurs in the monochrome 8-pass bidirectional printing having a great pass count. This is probably because of the following two reasons. Specifically, as described in the foregoing, for one, the carriage is affected by vibration that occurs upon reversal of the scanning direction of the carriage. For another, the carriage is affected by an unstable speed state during acceleration up to a predetermined speed level after the carriage has been temporarily decelerated for reversal.

Figure 7:
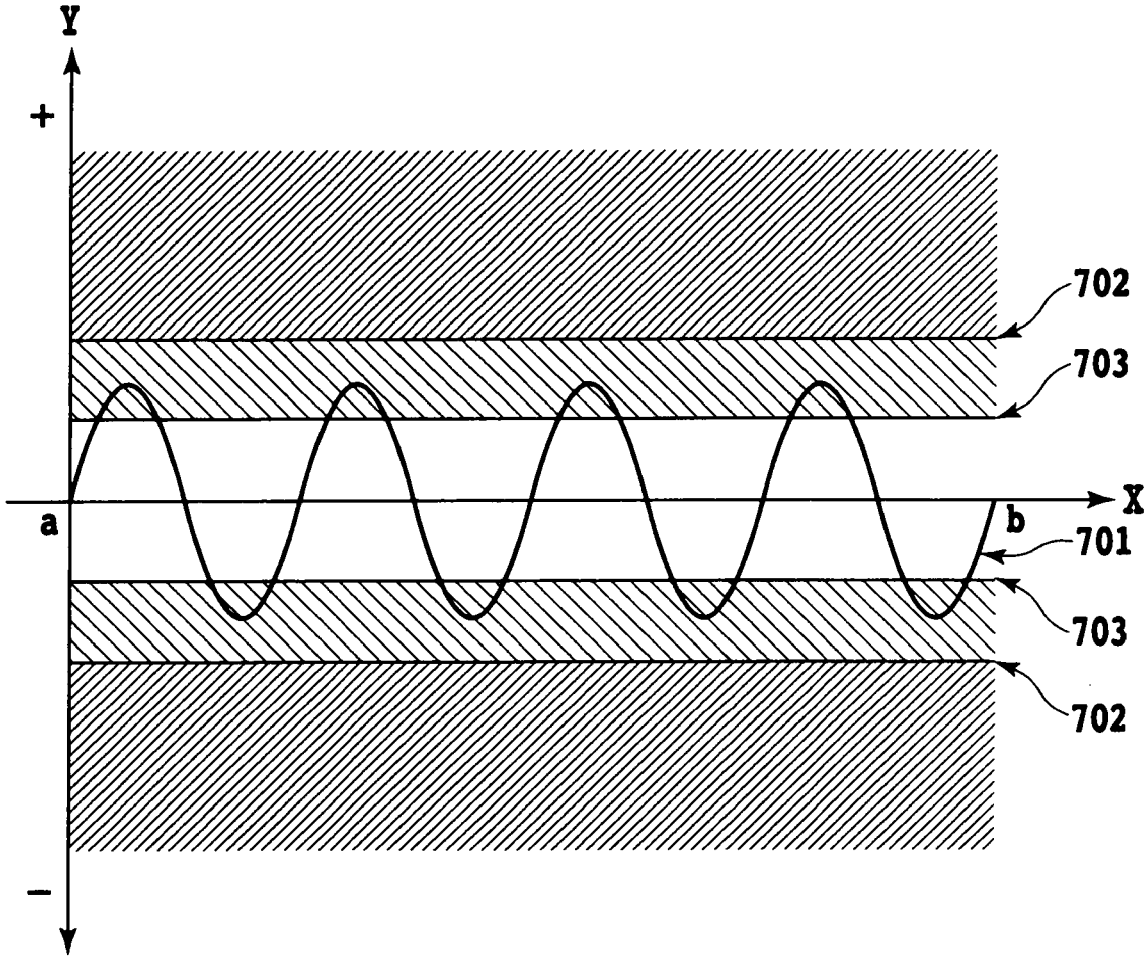
FIG. 7 is a diagram for illustrating an unevenness of density generating in 8-pass bidirectional printing in the monochrome print mode.

FIG. 7 is a diagram for illustrating deviation in ink dot landing positions occurring near the point of reversal of the scanning direction of the carriage in the 8-pass bidirectional printing in the monochrome print mode.

An X-axis represents a coordinate axis in the main scanning direction on the print medium. A curve 701 extending from a to b represents an actual print area. A Y-axis indicates an amount of deviation of the ink dot landing position from an ideal position on the print medium. The positive direction of the Y-axis is deviation toward a forward direction of the carriage. The negative direction of the Y-axis is deviation toward a direction opposite to the forward direction (or a backward direction) of the carriage. It is known that the dot lands on positions deviating cyclically in the forward and backward directions of the carriage. Here, a line 702 represents a boundary line, within which deviation in the landing position in color printing is not recognized as unevenness. If the amount of deviation exceeds the line 702, that specific deviation in the landing position is recognized as unevenness. A line 703 represents a boundary line, within which deviation in the landing position in monochrome printing is not recognized as unevenness. It is then known that the amount of deviation falls within the line 702, but cyclically exceeds the line 703. It is thus known that the deviation in the landing position that is not recognized as unevenness in color printing is recognized as unevenness in monochrome printing.

The inventors found that occurrence of unevenness could be suppressed by using unidirectional printing and adjusting an ejection start position of black ink.

Figure 8A:
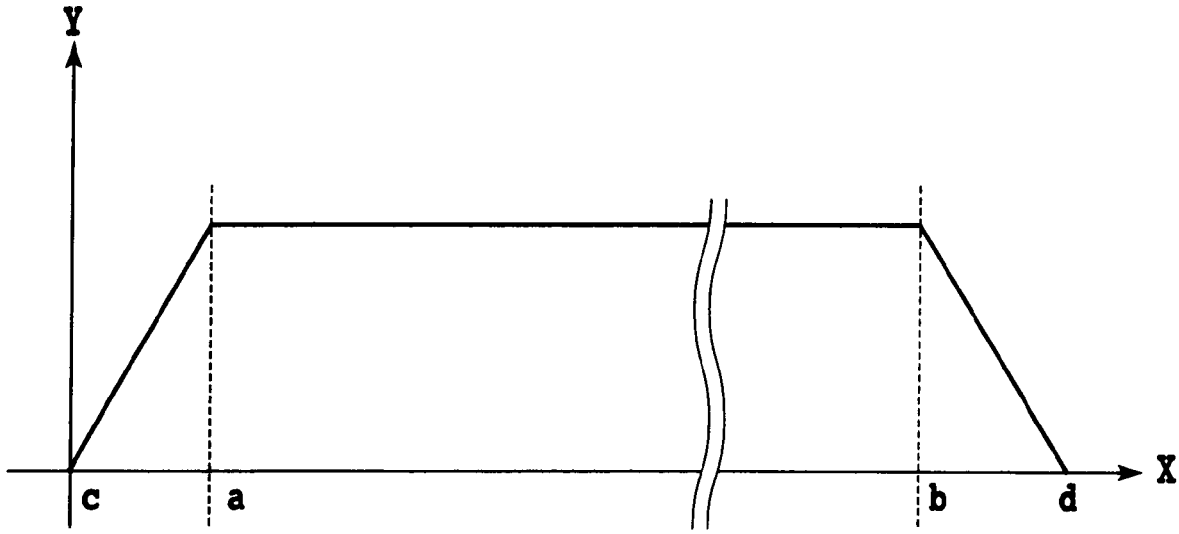
FIG. 8A is a diagram showing changes in speed of a carriage in 8-pass unidirectional printing in the monochrome print mode.

FIG. 8A is a diagram showing changes in the speed of the carriage during a single scan motion in unidirectional printing. An X-axis represents a coordinate axis in the main scanning direction on the print medium. A Y-axis indicates the speed of the carriage on the print medium. A line from c to a represents an acceleration zone required for making the carriage scan at a constant speed. A line from a to b represents a print zone through an actual scan motion at a constant speed. A line from b to d represents a deceleration zone of the carriage following the completion of printing through the scan motion at the constant speed. In FIG. 8A, printing takes place in the direction from a to b.

Figure 8B:
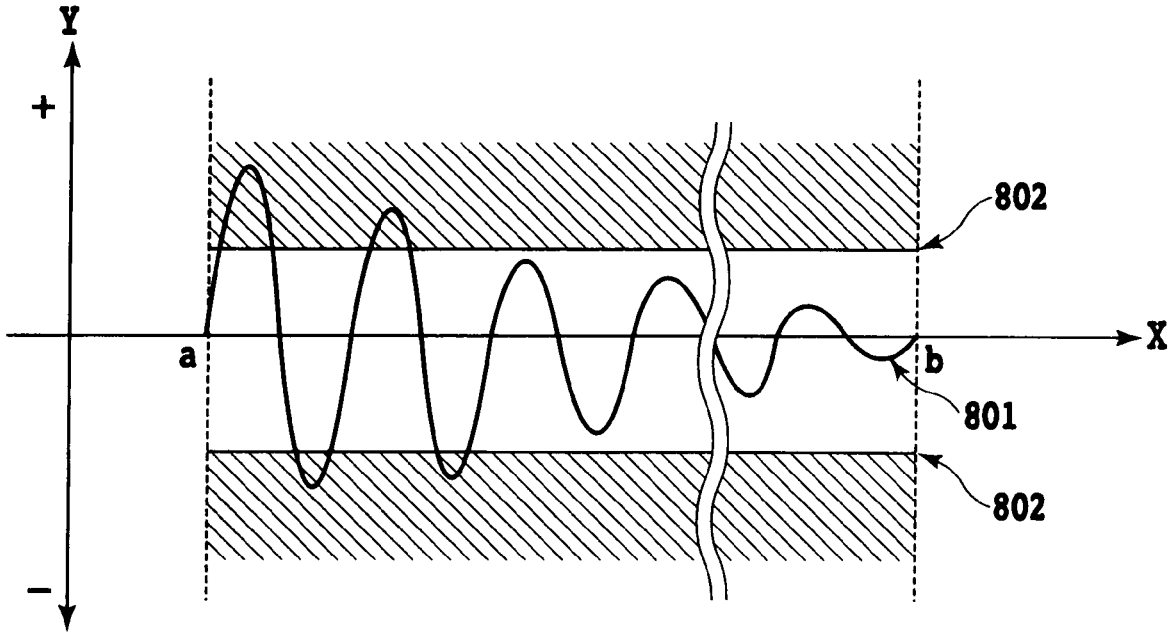
FIG. 8B is a diagram for illustrating an amount of deviation in dot landing positions with the carriage in a constant speed state.

FIG. 8B is a diagram for illustrating vibration of the carriage that causes deviation in dot landing positions when the carriage makes a scan motion at the constant speed in the print zone from a to b shown in FIG. 8A. An X-axis represents a coordinate axis in the main scanning direction on the print medium. AY-axis indicates amplitude. A curve 801 represents carriage vibration at this time. It is known that the carriage vibration exhibits the maximum amplitude immediately after the carriage has started the scan motion at the constant speed and thereafter damps. A middle gradation image in monochrome printing is observed in an 8-pass motion at this time. It is then confirmed that unevenness occurs at a location corresponding to the maximum amplitude of the carriage vibration and is gone so as to follow damping.

This is schematically represented by a line 802 shown in FIG. 8B. The line 802 is the boundary line, within which deviation in the dot landing position is not recognized as unevenness. Beyond the line 802, deviation in the dot landing position is recognized as unevenness. A portion exhibiting unevenness in the monochrome print mode is shown as shaded areas with downward-sloping lines.

Here, the inventors took particular note of the damping and found a method that uses unidirectional printing in the monochrome print mode and that the deviation of the dot landing position could be suppressed so as not to exceed the boundary line 802. This method will be described in the following.

As described earlier, the yellow ink and the like are used in addition to the black ink in the monochrome print mode. The black ink is the most, followed by the yellow ink, in terms of the amount of ink applied in middle gradations, in which deviation in the dot landing positions is most noticeable, as shown in FIG. 6B. It is therefore desirable that a condition, in which the carriage scans at the constant speed and the amplitude 801 does not exceed the boundary line 802, develop when the black ink is ejected. Meanwhile, the yellow ink has a lower contrast with the print medium as compared with the black ink. This helps make deviation in dot landing positions less noticeable with the yellow ink. Should the deviation in dot landing positions exceed the boundary line 802, therefore, it is less likely that the deviation in dot landing positions is recognized as unevenness to human eyes. The nozzle rows are therefore arranged such that the yellow ink is ejected in the condition, in which the amplitude of the deviation in dot landing positions immediately after the carriage scanning speed has become constant exceeds the boundary line 802, and that the black ink is ejected when the amplitude falls within the boundary line 802.

Figure 9A:
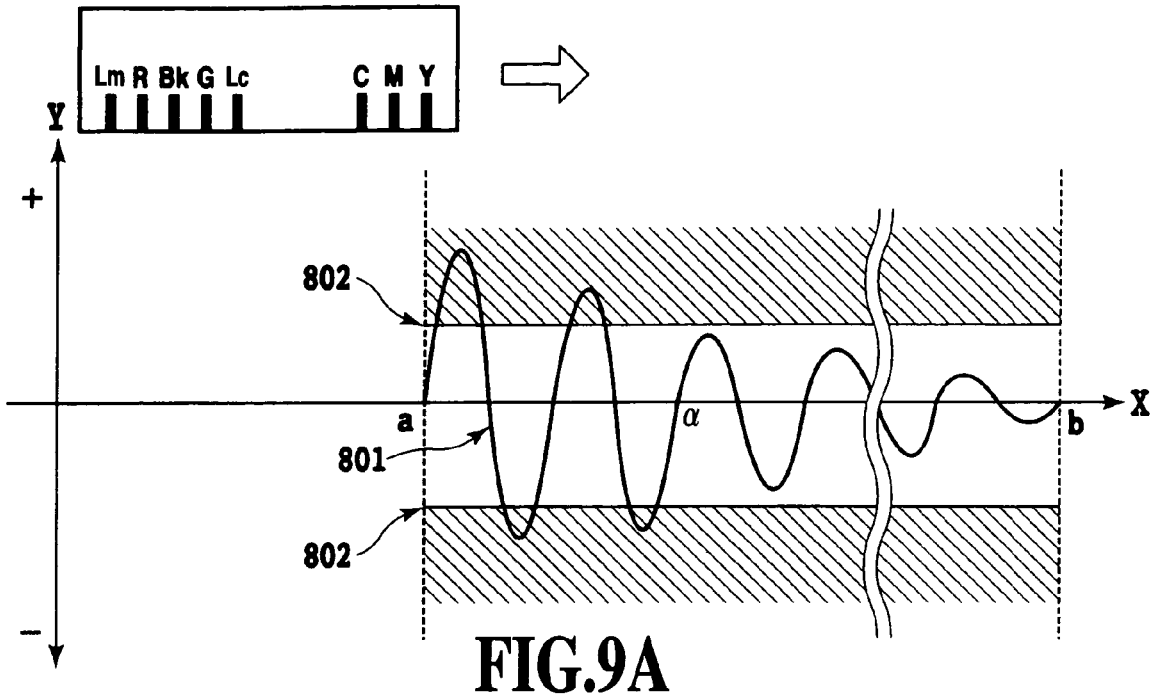
FIG. 9A is a diagram showing a relation between an amount of deviation in dot landing positions and a location of nozzle trains with the carriage in a constant speed state in 8-pass unidirectional printing in the monochrome print mode at the start of ejection of yellow ink.
Figure 9B:
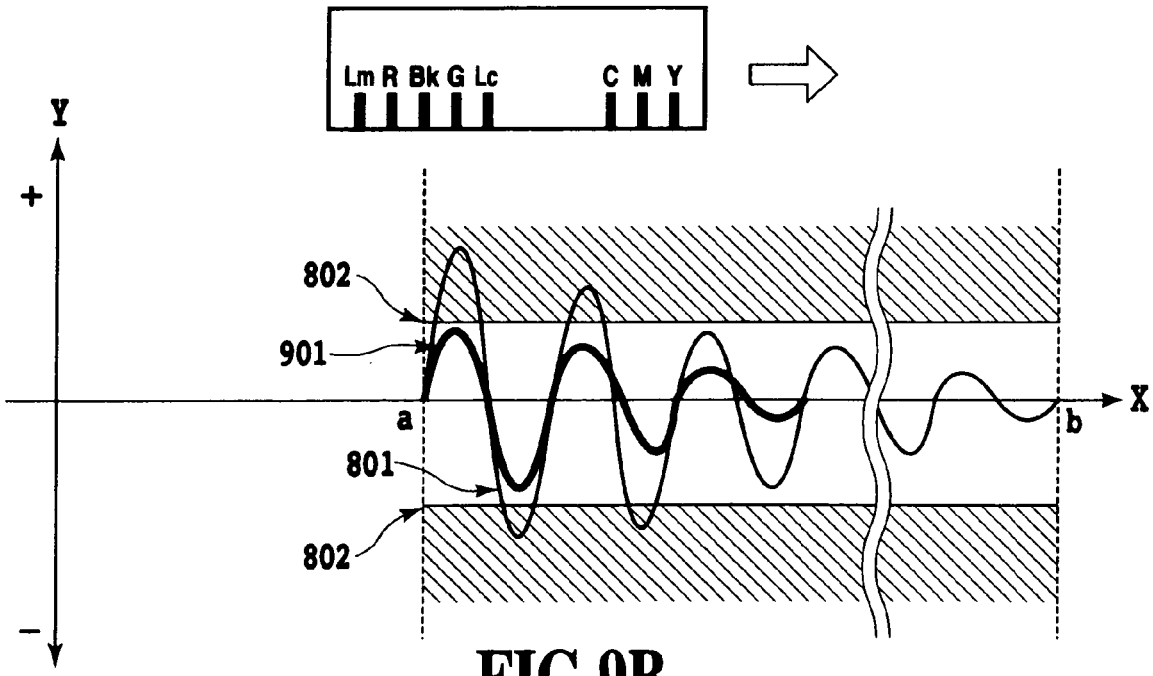
FIG. 9B is a diagram showing a relation between an amount of deviation in dot landing positions and a location of nozzle trains with the carriage in a constant speed state in 8-pass unidirectional printing in the monochrome print mode at the start of ejection of black ink.

FIGS. 9A and 9B are diagrams showing a relation between the amplitude of deviation in dot landing positions and the carriage position.

Reference is made to FIG. 9A. Ejection of ink is to be started at timing a when the carriage speed reaches the constant level. The nozzle row of the yellow ink is positioned at a head in the scanning direction so that the yellow ink is ejected when the carriage vibration is severe. As the carriage makes a scan motion and time elapses from timing a to timing α, the carriage vibration has substantially subsided and the amplitude of deviation in the dot landing positions has substantially damped. At timing α, the nozzle row of the black ink is positioned at the ejection start position (see FIG. 9B). As shown by a curve 901 in FIG. 9B, the amplitude of deviation in the dot landing positions does not exceed the boundary line 802 (see the curve 901) at the start of ejection of the black ink. Black dots then do not deviate largely from the ideal position. No unevenness thus occurs in the print result. According to Embodiment 1, the aforementioned relation of ejection start timing is achieved by allowing a distance of 2.25 cm between the nozzle row of the yellow ink and the nozzle row of the black ink. By implementing the unidirectional printing starting, in ejection order, with yellow that exhibits deviation in dot landing positions less noticeable as described in the foregoing, it is possible to suppress deviation in dot landing positions of the black ink. In addition, the print start position can also be set at a location substantially close to the home position. This allows time it takes the carriage to start ejection after leaving the home position to be shortened, contributing to a shorter time required for printing.

Assuming that the scan motion of the print head from the home position toward the other end is in the outgoing direction, unidirectional printing may be carried out through the scan motion in the return direction only in the monochrome print mode. Generally, a stack of print sheets is loaded as close as possible to the home position in a printing apparatus capable of printing data on print sheets of several different sizes. This means that the distance from the home position to an edge of the paper is short. As a result, it is highly likely that vibration of the carriage speed at the start of printing affects the image. Then, unidirectional printing is employed, in which printing starts with the other end relative to the home position, and the position away from the edge of the paper is set as the scan start position. This approach results in the vibration of the carriage speed having damped to an extent not affecting the image at the print start position on the print sheet. This in turn allows occurrence of unevenness to be suppressed. When the printing is carried out on a print sheet of a size smaller than the maximum size applicable to the printing apparatus, the scan area not involving printing on the other end of the home position can be provided largely. According to the aforementioned approach, therefore, it is possible to damp the vibration of the carriage speed to the extent not affecting the image by the carriage reaches the print start position on the print sheet.

As described in the foregoing, according to Embodiment 1, the number of colors of ink used for printing is smaller in the monochrome print mode than in the color print mode. Further, unidirectional printing is used in the monochrome print mode, while bidirectional printing is used in the color print mode. For possible effects of carriage speed vibration on the image as shown in FIGS. 8A and 8B, the effects are evident on both edges of the print sheet in bidirectional printing, resulting in unevenness being noticeable in the printed image. Using the unidirectional printing in the monochrome print mode, in which the number of colors of ink used is small, unevenness, should one occur, is evident only on one end in the carriage scanning direction. In addition, printing is invariably carried out in one direction only with respect to one print sheet. This allows unevenness to be superimposed on one another, helping make the overall unevenness less noticeable. It should be noted that, in the color print mode, the number of colors of ink used is relatively large, and the image is printed using a plurality of nozzle rows corresponding to the number of colors of ink. Unevenness therefore comes from each of the plurality of nozzle rows. Unevenness also comes from vibration of the carriage speed. These unevenness are superimposed one on top of another. This helps make unevenness in the color print mode not as noticeable as in the monochrome print mode.

Unevenness noticeable in the monochrome print mode can even further be reduced by the following approach, in addition to the control of using unidirectional printing in the monochrome print mode. Specifically, the pass count required for completing the image is made larger in the monochrome print mode than in the color print mode.

Embodiment 2

Correcting color tone using chromatic colors may not be required and the black ink only is required in the monochrome print mode, depending on the print medium. In this case, printing is carried out by flatly increasing the amount of the black ink used from the highlight portion to the maximum density portion.

When printing is carried out using only the black ink in such a case, an attempt is made to shorten time it takes the carriage to start ejection after leaving the home position. To achieve that purpose, if the nozzle rows are arranged so that the nozzle row of the black ink is in the position of the nozzle row of the yellow ink in Embodiment 1, printing is started immediately after the carriage has become the constant speed state from the accelerated state. This causes dots to land on positions largely deviating from ideal ones, thus resulting in unevenness occurring. In this case, too, printing is therefore carried out with the nozzle row of the black ink positioned in the carriage in the same manner as in Embodiment 1. That is, ejection of the black ink is started in the condition shown in FIG. 9B, thus yielding the same effect as in Embodiment 1.

Embodiment 3

There may be need for single color printing besides the monochrome print mode. In such a case, too, by the same token of the aspect of Embodiment 2 of the present invention, the nozzle row of the color ink to be used for printing should be arranged so as to reach the print start position at the same timing as the nozzle row of the black ink in Embodiment 2. Specifically, the nozzle row of the color ink to be used for printing should be arranged so as to be in the position of the black ink in FIG. 9A or in rear thereof in the carriage forwarding direction. This arrangement allows printing to start when vibration of the carriage is small.

The black ink exhibits an intense contrast, making unevenness easily noticeable even to the human eyes. Unevenness of the ink of the single color in single color printing may be less noticeable to the human eyes depending on hue of the ink of the single color. As long as the unevenness is not so noticeable, the nozzle row of the color ink concerned may be situated more on the side of the nozzle row of the yellow ink than the nozzle row of the black ink in FIGS. 9A and 9B.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-024842 filed Jan. 30, 2004, which is hereby incorporated by reference herein.

What is claimed is:

1. An ink jet printing apparatus for forming an image on a print medium by performing a printing operation and a print medium feeding operation; the printing operation performed by making a print head carry out a plurality of scan motions in a predetermined direction on the print medium, the print head having an array of a plurality of nozzle rows corresponding to the required number of colors of ink to be ejected, each nozzle row including a plurality of nozzles, each scan motion involving the ink being ejected from the plurality of nozzles onto the print medium; the print medium feeding operation performed by moving the print medium and the print head relative to each other a predetermined amount in a direction different from a direction of the scan motion of the print head; the ink jet printing apparatus comprising:

print mode selection means for selecting one print mode among a plurality of print modes including a first print mode and a second print mode, the first print mode using a relatively large number of colors of ink employed for printing and the second print mode using an achromatic ink and a number of colors of chromatic ink smaller than in the first print mode; and control means for controlling the printing operation according to the print mode selected by the print mode selection means;

wherein the control means controls so that in the first print mode bidirectional printing, in which a printing operation is performed during scan motions both in the predetermined direction and a direction opposite thereto, is carried out, and in the second print mode unidirectional printing, in which a printing operation is performed only during a scan motion in either the predetermined direction or the direction opposite thereto, is carried out, wherein, in image formation in the first print mode and the second print mode, printing of an image over a predetermined area on the print medium is completed through a plurality of scan motions of the print head by repeating the printing operation achieved through the scan motion of the print head and the print medium feeding operation covering a width narrower than a print width printed through one scan motion of the print head in a print medium feeding direction, and wherein, in printing in the second print mode, at least yellow ink is ejected before an achromatic ink.

2. The ink jet printing apparatus as claimed in claim 1, wherein each of the nozzle rows is disposed such that the nozzle row of the achromatic color of ink to be ejected reaches a print start position when, in the second print mode, an amplitude of vibration of the print head during the scan motion thereof is a predetermined amount or less.

3. The ink jet printing apparatus as claimed in claim 2, wherein a nozzle row ejecting ink of a color having a lightness value greater than the achromatic color is disposed forward the nozzle row of the predetermined color in the direction of the scan motion of the print head in the printing operation in the second print mode.

4. A printing system using an ink jet printing apparatus for forming an image on a print medium by performing a printing operation and a print medium feeding operation; the printing operation performed by making a print head carry out a plurality of scan motions in a predetermined direction on the print medium, the print head having an array of a plurality of nozzle rows corresponding to the required number of colors of ink to be ejected, each nozzle row including a plurality of nozzles, each scan motion involving the ink being ejected from the plurality of nozzles onto the print medium; the print medium feeding operation performed by moving the print medium and the print head relative to each other a predetermined amount in a direction different from a direction of the scan motion of the print head; the printing system comprising:

print mode selection means for selecting one print mode among a plurality of print modes including a first print mode and a second print mode, the first print mode using a relatively large number of colors of ink employed for printing and the second print mode using an achromatic ink and a number of colors of chromatic ink smaller than in the first print mode; and control means for controlling the printing operation according to a print method according to the print mode selected by the print mode selection means;

wherein the control means controls so that in the first print mode bidirectional printing, in which a printing operation is performed during scan motions both in the predetermined direction and a direction opposite thereto, is carried out, and in the second print mode unidirectional printing, in which a printing operation is performed only during a scan motion in either the predetermined direction or the direction opposite thereto, is carried out, wherein, in image formation in the first print mode and the second print mode, printing of an image over a predetermined area on the print medium is completed through a plurality of scan motions of the print head by repeating the printing operation achieved through the scan motion of the print head and the print medium feeding operation covering a width narrower than a print width printed through one scan motion of the print head in a print medium feeding direction, and wherein, in printing in the second print mode, at least yellow ink is ejected before an achromatic ink.

5. An ink jet printing method using an ink jet printing apparatus for forming an image on a print medium by performing a printing operation and a print medium feeding operation; the printing operation performed by making a print head carry out a plurality of scan motions in a predetermined direction on the print medium, the print head having an array of a plurality of nozzle rows corresponding to the required number of colors of ink to be ejected, each nozzle row including a plurality of nozzles, each scan motion involving the ink being ejected from the plurality of nozzles onto the print medium; the print medium feeding operation performed by moving the print medium and the print head relative to each other a predetermined amount in a direction different from a direction of the scan motion of the print head; the ink jet printing method comprising:

a print mode selection process for selecting one print mode among a plurality of print modes including a first print mode and a second print mode, the first print mode using a relatively large number of colors of ink employed for printing and the second print mode using a number of colors of ink smaller than in the first print mode; and a print process for performing the printing operation according to the print mode selected by the print mode selection process;

wherein the print process performs so that in the first print mode bidirectional printing, in which a printing operation is performed during scan motions both in the predetermined direction and a direction opposite thereto, is caffied out, and in the second print mode unidirectional printing, in which a printing operation is performed only during a scan motion in either the predetermined direction or the direction opposite thereto, is carried out, wherein, in image formation in the first print mode and the second print mode, printing of an image over a predetermined area on the print medium is completed through a plurality of scan motions of the print head by repeating the printing operation achieved through the scan motion of the print head and the print medium feeding operation covering a width narrower than a print width printed through one scan motion of the print head in a print medium feeding direction, and wherein, in printing in the second print mode, at least yellow ink is ejected before an achromatic ink.

* * * * *

UNITED STATES PATENT AND TRADEMARK OFFICE

CERTIFICATE OF CORRECTION

PATENT NO. : 7,357,483 B2
APPLICATION NO. : 11/042103
DATED : April 15, 2008
INVENTOR(S) : Daisaku Ide et al.

It is certified that error appears in the above-identified patent and that said Letters Patent is hereby corrected as shown below:

COLUMN 5:

Line 4, “according” should read --according to--; and
Line 54, “pairs” should read --the pairs--.

COLUMN 6:

Line 14, “Sub scan” should read --sub-scan--;
Line 26, “afore-mentioned” should read --aforementioned--;
Line 29, “afore-mentioned” should read --aforementioned--; and
Line 56, “magenta 1M,” should read --magenta 11M--.

COLUMN 7:

Line 56, “include” should read --includes--.

COLUMN 8:

Line 20, “which” should read --upon which--;
Line 30, “input” should read --the input--;
Line 36, “colors” should read --the colors--; and
Line 37, “colors” should read --the colors--.

COLUMN 10:

Line 21, “high” should read --higher--;
Line 22, “a samey” should read --the same--;
Line 59, “IN” should read --In--; and
Line 61, “ink of colors” should read --colors of ink--.

COLUMN 11:

Line 8, “samey” should read --same--; and
Line 15, “different” should read --the different--.

COLUMN 13:

Line 44, “develop” should read --develops--.

UNITED STATES PATENT AND TRADEMARK OFFICE

CERTIFICATE OF CORRECTION

PATENT NO. : 7,357,483 B2
APPLICATION NO. : 11/042103
DATED : April 15, 2008
INVENTOR(S) : Daisaku Ide et al.

It is certified that error appears in the above-identified patent and that said Letters Patent is hereby corrected as shown below:

COLUMN 15:

Line 2, “unevenness” should read --unevennesses--; and
Line 20, “time” should read --the time--.

COLUMN 17:

Line 18, “mode” should read --mode,--.

COLUMN 18:

Line 21, “mode” should read --mode,--;
Line 24, “caffied” should read --carried--.

Signed and Sealed this

Sixteenth Day of September, 2008

JON W. DUDAS
*Director of the United States Patent and Trademark Office*